US005192192A

United States Patent [19]

Ourhaan

[11] Patent Number: 5,192,192

[45] Date of Patent: Mar. 9, 1993

[54] TURBINE ENGINE FOIL CAP

[75] Inventor: Tracy R. Ourhaan, Miami, Fla.

[73] Assignee: The United States of America as represented by The Secretary of the Air Force, Washington, D.C.

[21] Appl. No.: 619,271

[22] Filed: Nov. 28, 1990

[51] Int. Cl.[5] ..... F01D 5/18

[52] U.S. Cl. ..... 416/97 R; 415/115

[58] Field of Search ..... 416/90 R, 92, 95, 96 R, 416/96 A, 97 R, 97 A; 415/115, 116

[56] References Cited

U.S. PATENT DOCUMENTS

| | | | |
|---|---|---|---|
| 3,329,596 | 7/1967 | Abt et al. . | |
| 3,527,543 | 9/1970 | Howald . | |
| 3,810,711 | 5/1974 | Emmerson et al. | 416/97 A |
| 4,142,824 | 3/1979 | Anderson | 415/115 |
| 4,159,407 | 6/1979 | Wilkinson et al. . | |
| 4,197,443 | 4/1980 | Sidenstick . | |
| 4,424,001 | 1/1984 | North et al. | 416/96 R |
| 4,487,550 | 12/1984 | Horvath et al. | 416/92 A |
| 4,650,949 | 3/1987 | Field . | |
| 4,726,104 | 2/1988 | Foster et al. | 416/97 R |
| 4,738,588 | 4/1988 | Field | 415/115 |
| 4,761,116 | 8/1988 | Braddy et al. | 416/97 R |

*Primary Examiner*—Edward K. Look
*Assistant Examiner*—James A. Larson
*Attorney, Agent, or Firm*—Thomas C. Stover; Donald J. Singer

[57] ABSTRACT

In an axial flow turbo-machine such as a gas turbine engine, a foil cap for hollow blades or cantilevered vanes, aft of the combustion chamber thereof is provided, the cap having cooling apertures therethrough which diverge from inside to outside thereof, the improvement being, placing at least some of such cooling apertures to intersect with the junction of end and side surfaces of such cap, to scallop same, so that such cooling apertures cannot be blocked by contact of such cap with a clearance control body in such engine. The so-positioned junction-intersecting, cooling apertures, intersect the foil cap surfaces at an angle and lay down a cooling air film on the end and side surfaces of such cap, even when the cap is contacted with the clearance control body, to maintain a cooling film shield thereon against high temperature engine combustion gases and to reduce the oxidation and erosion of such foil cap that would otherwise occur.

5 Claims, 4 Drawing Sheets

TURBINE ENGINE FOIL CAP

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention

This invention relates to improved vanes or blades of a gas turbine engine, particularly an improved foil cap therefor.

2. The Prior Art

In the high operating temperatures of gas turbine engines sufficient gas cooling of foils, including vane and/or blade surfaces is important if not essential. The prior art has expended considerable effort in cooling designs for such vanes and blades located, e.g. aft of the engine combustion chamber. Generally in the prior art, cooling gas, e.g. air, is directed into a hollow vane or blade and through apertures in the walls thereof, which apertures are, e.g. slanted and flared to lay down a cooling gas film on the vane or blade exterior surfaces, to provide a cooling gas film layer thereon against the oncoming combustion core gas stream.

For examples of such vane or blade cooling efforts see U.S. Pat. No. 3,527,543 to Howald (1970), U.S. Pat. No. 4,197,443 to Sidenstick (1980), U.S. Pat. No. 4,589,823 to Koffel (1986) and U.S. Pat. No. 4,650,949 to Field (1987).

The above references teach forming cooling apertures through the walls of vanes or blades at an angle with the exterior surface thereof employing cylindrical apertures (Koffel), conical apertures (Howald) or apertures which flare at the exit end thereof (Sidenstick and Field). These references teach cooling of the sidewalls of the respective vanes and blades but do not address cooling of the cap end of, e.g. vanes, particularly (inwardly) cantilevered vanes, where core gas flow over the vane ends or root caps is desirably minimized while trying to preserve a cooling film thereover.

The cantilevered vanes are mounted, e.g. in a gas turbine engine supported outwardly and cantilevered inwardly and around an adjustable core body, known as an active clearance control, ACC, which can expand to close the gap therebetween to minimize the flow of engine core gases over the root caps and direct such flow between the vanes.

That is, in the prior art, cantilevered vane 10 has sidewall cooling apertures 12, with no apertures for the upper surfaces of the root cap 14, which is subject to oxidation and/or erosion caused by core gas contacting same, as indicated in FIG. 5.

In another example of the prior art, shown in FIG. 6, cantilevered vane 20 works in conjunction with active clearance control member (ACC) 22, which moves into contact with the upper surfaces 24 of the vane 20 so as to block core gas flow over the vane ends or root cap to thus reduce gas turbine performance (power and efficiency) losses and to direct such core gas flow between the vanes 20 as much as possible.

However, when the ACC 22 closes on the end 24 of the root cap 23, it seals off the cooling apertures 26 of the vane 20 and overheating of such cap results which can lead to oxidation and/or erosion thereof, unless the operating temperatures of the engine are significantly reduced, at the expense of efficiency and power thereof.

Accordingly, there is need and market for a foil cap for gas turbine blades and vanes, including cantilevered vanes, which can obviate the above prior art shortcomings.

There has now been discovered an improved foil cap design for gas turbine blades and cantilevered vanes which permits cooling of such caps even when an engine member is in contact therewith, for improved engine efficiency and higher operating temperatures.

SUMMARY OF THE INVENTION

Broadly the present invention provides in a foil cap for a gas turbine engine for hollow blades or hollow vanes, having cooling apertures from inside to outside thereof and exiting at an angle with the outside walls thereof for laying down a cooling gas film on such outside walls, the improvement comprising, forming such apertures in the cap so that at least some of the apertures exit at the outside corners of the cap at both top and side surfaces thereof, which apertures cannot be blocked by contacting the upper surface of said cap with a member, e.g. a clearance control member.

By "foil cap", as used herein, is meant a tip cap for blades or a root cap for vanes.

By "root cap", as used herein, is meant, e.g. that portion of the vane 30, above the dashed line 11, i.e. root cap 35, as shown in FIGS. 7 and 8. The tip cap is similarly defined with reference to FIGS. 7 and 8.

By "squealer cap" as used herein, is meant, e.g. that flat portion 41 (of the root cap 35) connecting between the ridge surfaces 37 and 38, as shown in FIG. 7. The blade squealer cap (of the tip cap) is similarly defined.

BRIEF DESCRIPTION OF THE DRAWINGS

The invention will become more apparent from the following detailed, specification and drawings in which.

DESCRIPTION OF PREFERRED EMBODIMENTS

Figure 1:
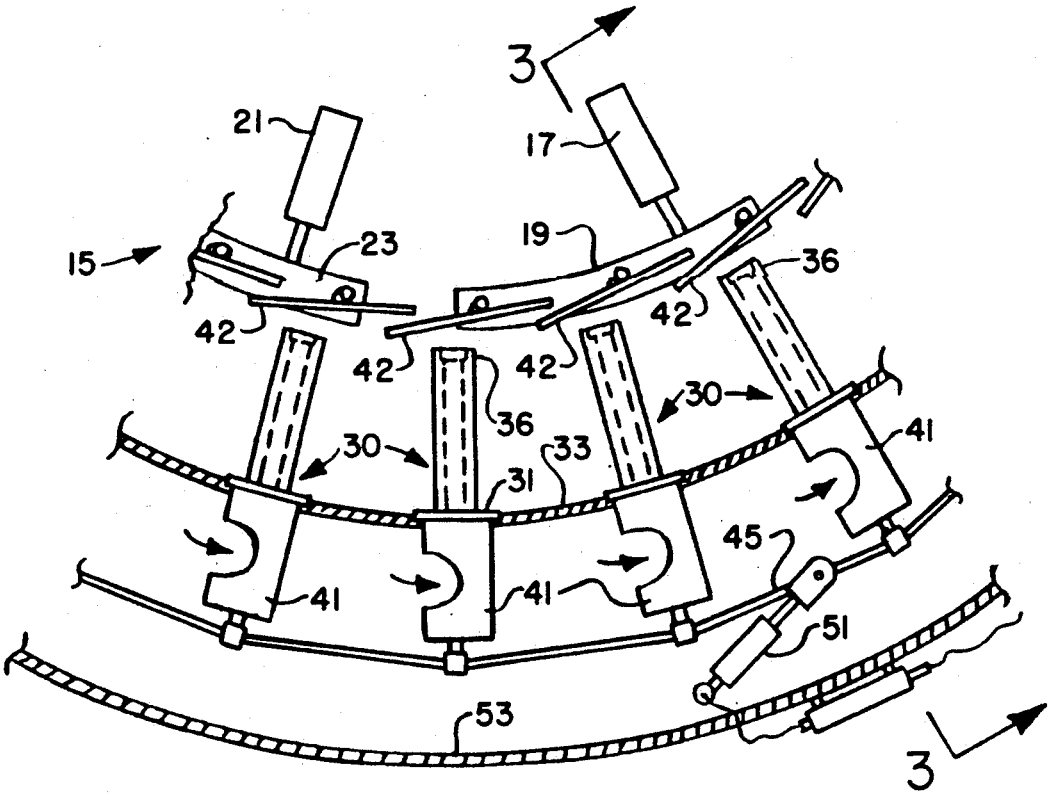
FIG. 1 is a fragmentary, cross-sectional, elevation view of a gas turbine engine with end elevation views of some of the cantilevered vanes embodying the present invention.
Figure 3:
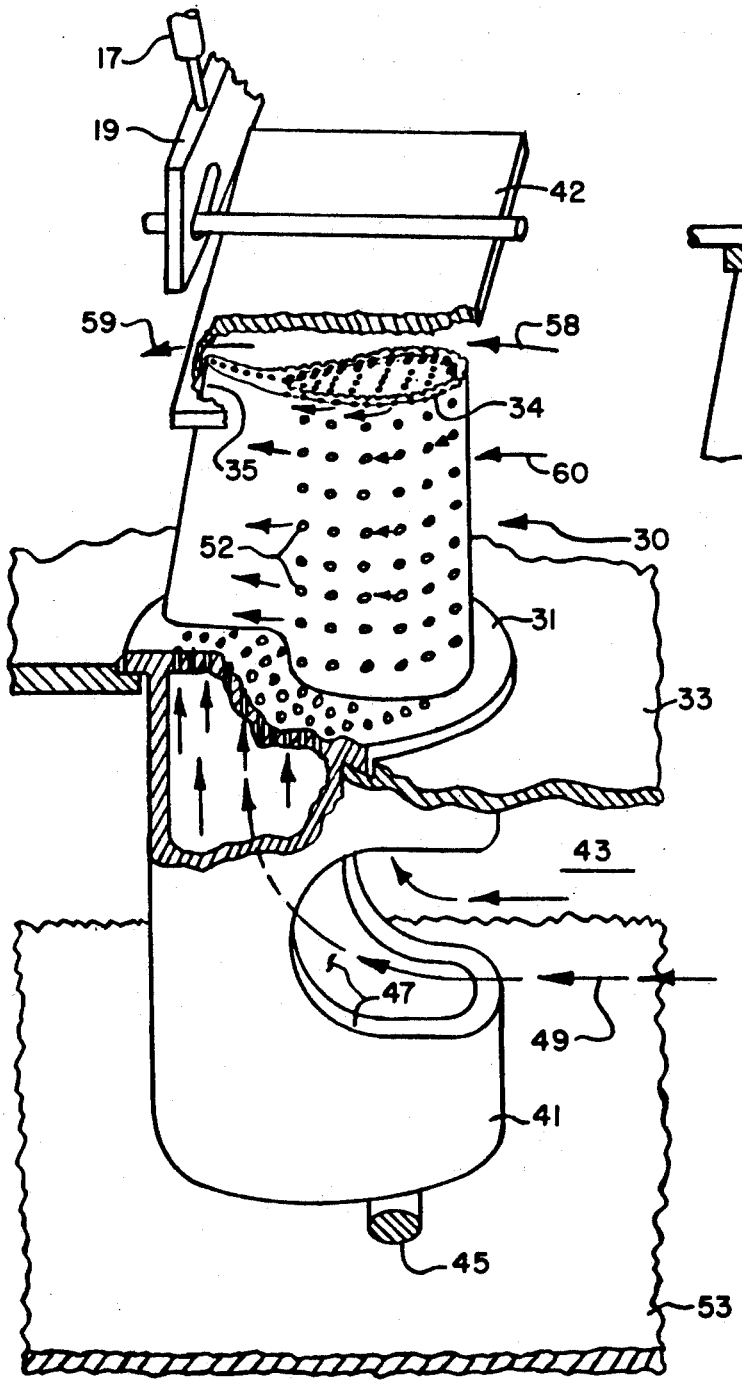
FIG. 3 is a fragmentary perspective view of the cantilevered vane of FIG. 1, taken on lines 3—3, looking in the direction of the arrows.

Referring in more detail to the drawings, each cantilevered vane 30 of the invention, pivotably mounts on apertured platform base 31, which in turn, mounts on the outer core wall 33 aft or downstream of the combustion chamber of a gas turbine engine (not shown), as indicated in FIGS. 1 and 3. The direction of core gas flow is into the plane of FIG. 1, between the outer core wall 33 and the ACC panels 42, shown in FIGS. 1 and 3, which core gas direction is indicated by arrows 58, 60 and 59, as shown in FIG. 3 Behind the vanes 30 are turbine blades and the engine exhaust nozzle, not shown in FIGS. 1 and 3.

Above the upper portion or root cap 35 of the vanes 30, is an ACC 15, which includes actuator 17, support bar 19 and ACC cover plates 42 pivotably mounted thereon, as shown in FIGS. 1 and 3. Extension of the actuators 17 will lower the support arms 19 and the cover plates 42 toward the root caps 35, closing the gaps therebetween until such cover plates 42 contact such root caps 35 and each other in close overlapping array as indicated in FIGS. 1, 2, 3 and 4. The hot core gases will be directed to flow between the upstanding vanes 30 and not over the root caps 35, for improved engine performance, thrust and efficiency.

However, the root caps 35, thus closed upon by the cover plates 42, will close off ventilation apertures therethrough unless cooling means are provided to overcome the blocking effects of such cover plates 42 on the root caps 35 of the vanes 30.

The vanes 30, though mounted to the outer core wall 33, extend therethrough into the compressor air bypass duct 43 by way of base 41, to contact linkage 45, which enables pivoting of such vanes 30, as shown or indicated in FIGS. 1 and 3.

Figure 2:
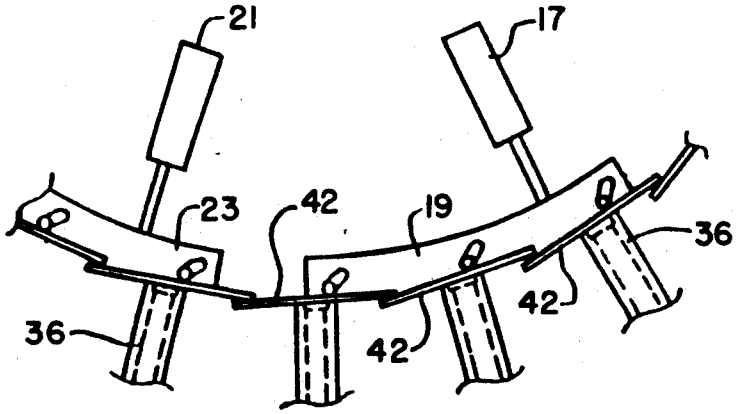
FIG. 2 is a fragmentary elevation view of components of the invention shown in FIG. 1.
Figure 6:
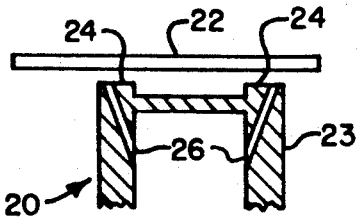
FIG. 6 (PRIOR ART)

The base 41 of each vane 30, has a hollow passage 47 therein which scoops bypass air per arrow 49, and directs it into the vane 30 and out certain cooling apertures in such vane and root cap 35, to lay down a cooling air film on the exterior surfaces thereof as indicated in FIGS. 1, 2 and 6 and more fully discussed below. Air is directed also through apertures in the base 31 (of each vane 30) to provide a cooling film thereon in the manner discussed below with respect to the upper portions of the vane 30.

The air bypass duct 43 is an annulus defined by the outer core wall 33 and the outer engine wall or shroud 53, as shown in FIGS. 1 and 3. In such annulus, linkage 45, which connects to each vane 30, is powered by actuator 51 mounted, to the shroud 53, which pivots the vane to a desired angle to the oncoming core gases represented by arrows 58 and 60 in FIG. 3, e.g. for swirl correction purposes.

Figure 4:
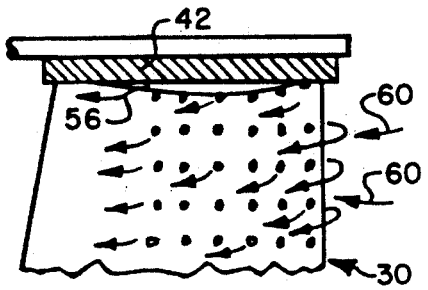
FIG. 4 is a fragmentary elevation view of components of the invention shown in FIG. 3.
Figure 5:
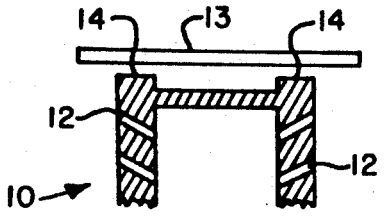
FIG. 5 (PRIOR ART)
FIGS. 5 and 6 are fragmentary sectional elevation views of cantilevered vanes and root caps according to the prior art.
Figure 7:
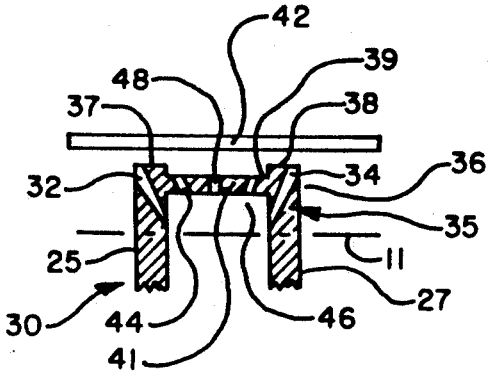
FIG. 7 is a fragmentary sectional elevation view of a cantilevered vane and root cap according to the present invention.

In the above context, the present invention concerns itself with how best to cool the root cap 35 of each vane 30, once the ACC cover plate 42 closes down on the top thereof, as shown in FIGS. 2, 4 and 7.

As noted above in the prior art (FIG. 6), when the ACC cover plate 22 moves into contact with the upper surfaces 24 of the root cap 23, it blocks the bypass air cooling apertures 26 of the vane 20 and overheating of such cap can result which can lead to oxidation and/or erosion thereof.

The root cap of the present invention is provided with cooling apertures therein, which avoid blocking by contact with the ACC cover plate while providing cooling air flow proximate the so-covered cap upper surfaces.

Figure 8:
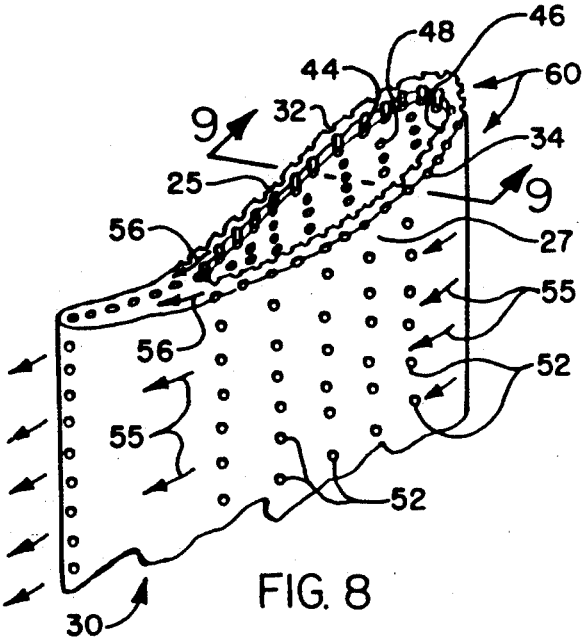
FIG. 8 is a fragmentary perspective view of the vane and root cap embodying the invention, shown in FIGS. 1, 3 and 7.
Figure 9:
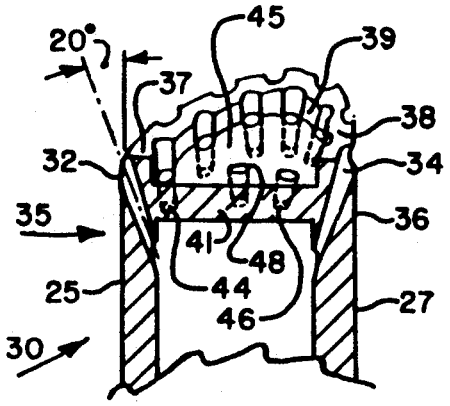
FIG. 9 is an enlarged fragmentary perspective view of the vane and root cap shown in FIG. 8, taken on lines 9—9, looking in the direction of the arrows.

Thus vane 30 of the invention, has exterior cap apertures 32 and 34 which exit at the side and top surfaces of the root cap 35, as shown in FIGS. 7 and 9. For example, the cooling aperture 34 exits at the junction of the side 36 and the ridge top surface 38 of the root cap 35, as shown in FIGS. 7 and 9 and indicated in FIG. 8. Also, as shown in FIGS. 7, 8 and 9, the apertures 32 and 34 exit at locations on the high pressure side 25 and low pressure side 27 of the vane (or blade) 30.

Lowering the ACC cover plate 42 into contact with the ridge top surfaces 37 and 38 of the root cap 35 will still not block such exterior cap apertures 32 and 34, as indicated in FIGS. 7,9 and 4.

The root cap 35 of the invention also has interior cap apertures 44 and 46 which can continue as grooves in the adjacent root cap ridge wall, as indicated in FIGS. 7,8 and 9. For example, interior cap groove 44 passes through the squealer cap 41 and continues as a groove in the root cap wall 39, as shown in FIG. 9. Thus for example, the exterior cap groove of aperture 34 and the interior cap groove of aperture 46 to name two, are scalloped into the upper cap walls 36 and 39 so as to assist in laying down a cooling air film on or proximate the root cap upper surfaces, e.g. ridge surface 38, when the ACC cover plate 42 closes down into contact therewith.

Such inner cap apertures need not scallop into the root cap wall but can be set inwardly thereof for cap cooling purposes, e.g. as in the case of interior cooling aperture 48, shown in FIGS. 7 and 9, as desired, within the scope of the invention.

The interior cap apertures, e.g. 46 and 48 continue to dispense a cooling air film on the squealer cap even when the ACC cover plate 42, shown in FIGS. 2, 4 and 7, is down on the ridge tops 37 and 38 because the fore and aft contours of such cover plate 42 and the root cap 35, have non-matching profiles, as shown in FIG. 4, so that gas flow gaps remain therebetween, particularly aft of the leading portion of such cap, which permit a rearward flow of cooling film from the interior and exterior cap apertures, to cool such cap against the oncoming flow of the hot combustion gases in the gas turbine engine.

Accordingly, per FIGS. 3 and 8, cooling gas e.g. air, enters into the hollow vane 30, as shown by arrow 49 and exits the vane via numerous sidewall apertures 52 and also through root cap outside apertures 32 and 34 and inside apertures 44, 46, and 48, as shown in FIGS. 8 and 4 and indicated in FIG. 7.

Thus a cooling film, indicated by arrows 55 and 56, is laid down over the sides and atop the root cap respectively, as a cooling blanket against the oncoming hot engine core gases represented by arrows 58 and 60, as shown in FIG. 8 and indicated in FIG. 4, where the ACC cover plate 42 is shown in close proximity with the vane 30.

Figure 11:
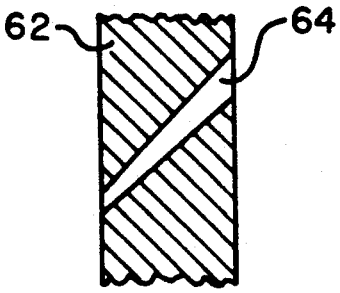
FIGS. 11 and 12 are fragmentary sectional elevation and fragmentary plan views respectively, of apertures employed in the root cap and vane embodying the present invention
Figure 12:
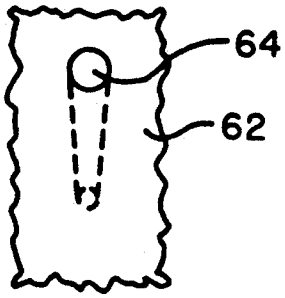
Figure 13:
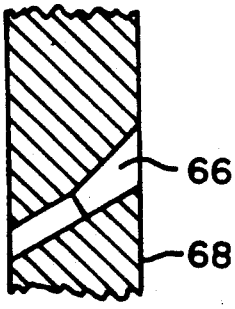
FIGS. 13 and 14 are fragmentary sectional elevation and fragmentary plan views respectively, of another embodiment of apertures located in the root cap and vane embodying the present invention.
Figure 14:
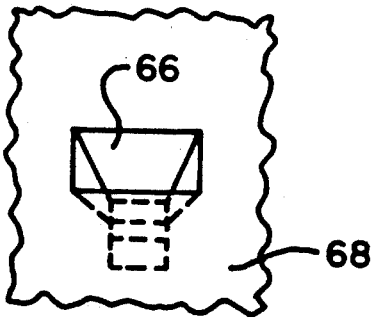

The root cap cooling apertures can take various shapes within the scope of the invention as long as they exit at an angle with the surface of such cap and preferably lay down a cooling film on the surface thereof. Thus, such cooling gas apertures can be, e.g. cylindrical, conical or angular in shape and preferably are larger at the outside cap walls than at the inside cap walls. For example, such cooling cap apertures can be conical in shape, such as aperture 64 (located in a vane or blade wall 62) shown in FIGS. 11 and 12 or can be angular and flare outwardly at the outside wall thereof, such as aperture 66 (located in a vane or blade wall 68), as shown in FIGS. 13 and 14.

Figure 10:
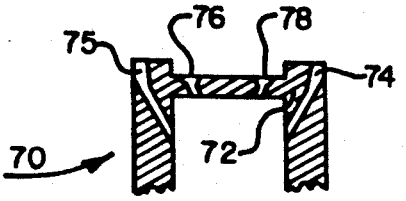
FIG. 10 is a fragmentary sectional elevation view of another embodiment of the vane and root cap of the present invention.

Thus in another embodiment of the invention, vane or blade 70 has foil cap 72 and outside flaring cap apertures 74 and 75 along with outwardly flaring interior cap apertures 76 and 78 as shown in FIG. 10. Various shaped cooling apertures can be employed within the scope of the invention but the above two specific shapes of conical and flaring are preferred. In a preferred example, a conical passage exiting a vane side wall or squealer cap outer surface at, e.g. 20°, will define an elliptical or similar outline at such exit surface, as indicated in FIG. 12.

Thus it can be seen that the cooling cap apertures of the present invention enable cooling of the root cap even when the ACC cover plate is in contact therewith, i.e. cap cooling films flow thereon from the inner and outer cap cooling apertures (e.g. apertures 46 and 34 shown in FIGS. 7 and 9), to provide a cooling shield thereon.

In the prior art, as exemplified by the vane 20 of FIG. 6, once the ACC cover plate 22 closes down thereon, the cooling apertures 26 are blocked, as noted above. However the outside junction intersecting, cap cooling apertures of the present invention cannot be blocked by the thus lowered ACC cover plate, as indicated in FIGS. 7 and 9. Thus one can calculate from pressure readings taken inside and outside the root cap e.g. readings taken on both sides of the squealer cap wall 41, the pressure differential therebetween and thence the flow through such apertures can be calculated using a heat transfer coefficient of such cap to predict a correct size and number of apertures to be inserted into such cap to obtain sufficient cooling with minimum power loss to the engine.

Thus with the ventilated root cap of the present invention, one can calculate such pressure differential by:

$$\Delta P = Pi/Pt$$

without taking into account the varying Pg of the prior art blockable root cap, e.g. of vane 20 of FIG. 6, which adds considerable complexity to the calculations;

where ΔP is the pressure differential; Pi is the air pressure within the vane; Pt is the core gas pressure of the engine and Pg is the gap pressure between the root cap and the ACC cover plate which changes as the plate moves relative to such root cap, e.g. to block the top surface apertures thereof.

That is, with an insufficient number and/or size of root cap apertures, such cap becomes overheated and subject to oxidation and erosion, particularly at the leading edge thereof. On the other hand, if the cooling apertures installed be excessive in number and/or size, sufficient cooling is obtained but at undue power loss to the engine. Thus such calculations, made possible by the foil or ventilated cap of the present invention, provide a savings in time and expense in the installation of apertures in such foil caps as well as in the vanes or blades to which such caps are mounted.

The cooling apertures are desirably formed in the foil cap in vane or blade by an electro-discharge machine apparatus, EDM, such as described in the above Sidenstick and Field references. Conical shaped apertures can be formed, e.g. using a conical EDM probe. In one example, these conical apertures are 0.014 inch dia. in the exterior and interior ridge walls (e.g. apertures 34 and 46 in FIG. 7) and exit at an angle with such walls to lay down a cooling film on the cap and vane surfaces. Inside the ridges on the root cap, apertures at about a 20°surface angle and 0.016 inch diameter, near the exit surface, (e.g. apertures 48 in squealer cap 41, shown in FIGS. 1 and 9), are employed to lay down a cooling film on the cap and vane surfaces. Of course, other sized and shaped cooling apertures can be employed to provide such cooling film as desired within the scope of the present invention.

The tip caps of engine blades, usually rotate in close clearance with the core shroud and need ventilation from within, to lay a cooling air film thereon. Thus such tips are configured in the manner of the root caps shown in FIGS. 7, 8 and 9, for similar cooling ventilation to ward off oxidation and/or erosion thereof from the hot core gas stream. Accordingly, the above disclosure, including the ΔP calculations, relative to the root cap configurations, applies as well, to the tip cap embodying the invention.

What is claimed is:

1. In a foil cap for a gas turbine engine for hollow blades or hollow vanes, having blade or vane cooling apertures from inside to outside thereof, which cap has top and outer side surfaces which meet to define outside corners, the improvement comprising, cap cooling apertures located in said cap which include corner apertures which exit at said outside corners at both said top and outer side surfaces at locations on the high and low pressure sides of said cap, wherein said corner, apertures cannot be blocked by contacting said top surfaces with a movable engine member, said top surfaces also intersecting with inside walls to define a ridge having inside corners, which ridge defines an enclosure such that at least some of said corner apertures exit at the outside corners of said ridge while some of said cap apertures exit proximate said inside walls of said ridge so that the outside corners of said ridge are scalloped by said corner apertures and the inside corners of said ridge are scalloped by extensions of said cap apertures.

2. The cap of claim 1 wherein a squealer cap extends across said enclosure within and below said ridge, which squealer cap has a plurality of angled cap apertures therethrough spaced inwardly of said ridge.

3. The cap of claim 1 wherein said cap apertures are tapering in cross section so as to be wider at the exit end thereof.

4. The cap of claim 3 wherein said cap apertures are conical in shape along the length thereof.

5. The cap of claim 3 wherein said cap apertures are angular in cross section and flare out at the exit end thereof.

* * * * *